US005101773A

United States Patent [19]

White

[11] Patent Number: 5,101,773

[45] Date of Patent: Apr. 7, 1992

[54] HEAT EXCHANGER FEED SYSTEM AND METHOD

[75] Inventor: Lawrence F. White, High Bridge, N.J.

[73] Assignee: Foster Wheeler Energy Corporation, Clinton, N.J.

[21] Appl. No.: 709,246

[22] Filed: Jun. 3, 1991

[51] Int. Cl.[5] ..... F22B 15/00; F22B 25/00; F22B 37/10

[52] U.S. Cl. ..... 122/235.13; 122/6.5; 122/6.6; 122/235.23

[58] Field of Search ..... 122/235.13, 235.23, 122/6.5, 6.6, 235.12

[56] References Cited

U.S. PATENT DOCUMENTS

| | | | |
|---|---|---|---|
| 2,242,491 | 5/1941 | Brunt et al. | 122/235.13 X |
| 3,875,904 | 4/1975 | Aström | 122/235.13 |
| 4,184,438 | 1/1980 | Bryers et al. . | |
| 4,184,456 | 1/1980 | Taylor et al. . | |
| 4,275,668 | 6/1981 | Daman . | |
| 4,394,849 | 7/1983 | Pratt et al. . | |
| 4,563,194 | 1/1986 | Simon | 122/235.23 |

*Primary Examiner*—Edward G. Favors
*Attorney, Agent, or Firm*—Marvin A. Naigur

[57] ABSTRACT

A heat exchanger feed system and method for distributing fuel through the walls of a combustor or other heat exchanger formed by a plurality of tubes each having first and second ends and adjacent tubes being connected to form an air-tight structure. A first series of the tubes are bent out of the plane of the wall to form a cylindrical passage extending at an angle to the wall through which material can flow. Each of the tubes in the series comprises a first vertical portion extending upwardly from the first end, a first diagonal portion extending upwardly from the first vertical portion and outwardly from the wall at an angle from the vertical, a second diagonal portion extending upwardly from the first diagonal portion and inwardly towards the wall at an angle from the horizontal, and a second vertical portion extending upwardly from the second diagonal portion to the second end. The passage is formed by bending the second diagonal portion of each of the tubes in the first series outwardly from the centerline of the inlet to form the passage.

20 Claims, 1 Drawing Sheet

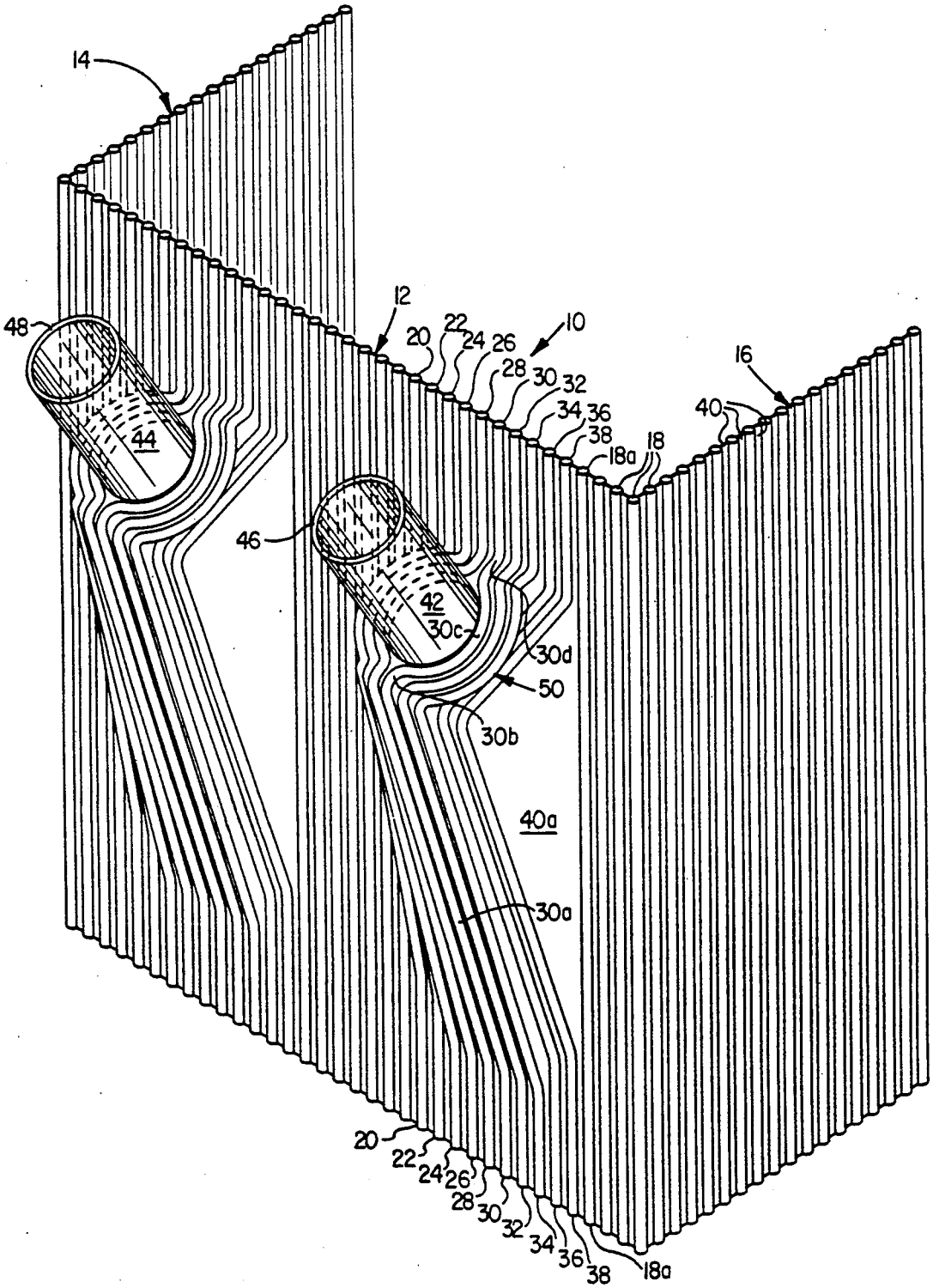
14
12
10
16
48
44
46
42
30c
30d
50
30b
40a
30a
40
20
22
24
26
28
30
32
34
36
38
18a
18

HEAT EXCHANGER FEED SYSTEM AND METHOD

BACKGROUND OF THE INVENTION

The present invention relates to fluidized bed combustors and the like and, more particularly, to a heat exchanger feed system and method for distributing fuel through the walls of a combustor or other heat exchanger.

The use of fluidized bed combustors has long been recognized as an attractive way of generating heat. In these arrangements, air is passed through a bed of particulate material, including a fuel, such as coal, for burning and an adsorbent, such as limestone, for adsorbing the sulfur generated as a result of the burning, to fluidize the bed and to promote the combustion of the fuel at a relatively low temperature. The heat produced by the burning of the fuel in the fluidized bed is utilized in various ways such as to generate electricity and to provide marine propulsion. The fluidized bed has become a preferred system of generating heat in combustors since it affords an attractive combination of high heat release, high sulfur adsorption, low nitrogen oxides emissions and a reduction in combustor size. A further advantage of fluidized bed combustors has been their fuel flexibility, however this advantage has been technologically limited by the design of the fuel feeding systems as described below.

In fluidized bed combustors, the particulate fuel material must be continuously, or at least periodically, distributed into the bed to replenish the spent fuel expended in the combustion process. It has been suggested to provide in-bed feeding systems in which the particulate fuel material is introduced directly into the bed from a point below the bed's upper surface. These systems, however, require a multiplicity of feed points to prevent hot spots or over-cool spots from forming in the bed since the lateral transfer or dispersion of the materials through the bed is relatively poor.

Therefore, many conventional fluidized bed combustors utilize a feeder, or feeders, which distribute the particulate fuel material from a position above the upper surface of the bed where it falls onto the bed by gravity. Pivotally mounted distributor trays can be used in connection with such above-bed feeders to insure a uniform distribution of the material across the upper surface of the bed as is shown in U.S. Pat. No. 4,275,668, a patent assigned to the same assignee as the present application.

These above-bed feeders typically use downspouts to deliver the material into the combustor. These downspouts must be sloped at relatively shallow angles to the horizontal to clear structures on the outside walls of the combustor such as buckstays, insulation and lagging, as well as to allow for expansion. These shallow angles, however, limit the types of materials which can be delivered through above-bed feeders to those with relatively small cohesive strengths. When materials with high cohesive strengths are delivered, the downspouts become clogged and the material flows unevenly due to the high friction forces which develop in shallow angled chutes. Therefore, even though fluidized bed combustors are able to efficiently consume many different types of fuels, no current technology exists to economically deliver all of these fuels into the combustor.

SUMMARY OF THE INVENTION

It is therefore an object of the present invention to provide a heat exchanger feed system and method which provides for a steep angle of injection through the walls of a combustor or other heat exchanger.

It is a further object of the present invention to provide a heat exchanger feed system and method of the above type in which clogging of the downspout is minimized.

It is a still further object of the present invention to provide a heat exchanger feed system and method of the above type which allows the delivery of materials with relatively high cohesive strengths into the combustor or other heat exchanger.

Toward the fulfillment of these and other objects, the heat exchanger feed system and method of the present invention provides a substantially vertical opening through the finned-tubed wall of a combustor or other heat exchanger. The opening is formed by bending a portion of the tubes out of the plane of the wall. A first series of tubes are bent away from the combustor at an angle of approximately 20° from the vertical, are then bent 90° toward the combustor to form an inlet face, at which point the tubes are bent outwardly from the centerline of the opening in a curved configuration to form a passage. The tubes are then bent back into the plane of the wall to rejoin the tubes in the wall. The tubes adjacent to the first series of tubes can also be bent out of the plane of the wall at slightly different angles than the first series of tubes, so that they extend behind the portions of the first series of tubes which comprise the inlet face.

BRIEF DESCRIPTION OF THE DRAWING

The above brief description, as well as further objects, features and advantages of the present invention, will be more fully appreciated by reference to the following detailed description of presently preferred but nonetheless illustrative embodiments in accordance with the present invention when taken in conjunction with the accompanying drawing which is a partial, perspective view of the present invention.

DESCRIPTION OF THE PREFERRED EMBODIMENT

Referring to the drawing, the reference numeral 10 refers in general to a fluidized bed combustor defined by a front wall 12, a rear wall (not shown) and two spaced side walls 14 and 16 to form a substantially rectangular vessel. The upper portion of the combustor 10 is not shown for the convenience of presentation, it being understood that it consists of a convection section, a roof and an outlet for allowing combustion gases to discharge from the combustor 10 in a conventional manner. Neither is the lower portion of the combustor 10 shown, also for the convenience of presentation, it being understood that it consists of a perforated grate on top of which is a bed of particulate material, including fuel, immediately below which is an air plenum chamber for distributing air from an external source through the grate to fluidize the bed. An example of such a combustor is shown in U.S. Pat. No. 4,275,668, a patent assigned to the same assignee as the present application.

As shown in the drawing, the walls 14 and 16 and the planar portions of the wall 12 (and those walls not shown) are formed of a plurality of straight tubes 18.

The wall 12 has two nonplanar portions, one of which is formed of a plurality of bent tubes 20–38. Each of the tubes 18–38 has continuous fins 40 extending outwardly from diametrically opposed portions thereof, with the fins of adjacent tubes being connected together in any known manner, such as by welding, to form a gas-tight structure. Headers (not shown) are disposed at the respective ends of each of the tubes 18–38 to permit circulation of water, steam and/or a water-steam mixture (hereinafter termed "fluid") through the tubes to heat the fluid to the extent that it can be used to perform work such as, for example, driving a steam turbine.

Portions of the tubes forming the two nonplanar portions of the wall 12, including the tubes 20–38, are bent to define generally circular openings, or inlets 42 and 44 through the wall 12. Downspouts, in the form of hollow cylinders, 46 and 48 register with the inlets 42 and 44, respectively, to create passages for receiving particulate fuel material and delivering same to the interior of the combustor 10 for burning. Since the inlets 42 and 44 are identical, only the inlet 42 will be described in detail.

To form the inlet 42, the tubes 24–34, which initially extend vertically from the lower portion of the combustor 10 to the upper portion thereof, are bent out of the plane of the wall 12. The bending is such that the tubes 24–34 are all first bent away from the combustor 10 at the same point on the wall 12 at an angle of approximately 20° from the vertical to form upwardly, diagonally extending portions shown, for example, by the reference numeral 30*a* in connection with the tube 30. All of the tubes 24–34 are then bent back approximately 90° towards the combustor 10, as shown, for example, by the reference numeral 30*b*, which portions of the tubes 24–34 form an inlet face 50. Starting at the base of the face 50, as it is portrayed in the drawing, the tubes 24–28 are bent outwardly towards the wall 14 and the tubes 30–34 are bent outwardly towards the wall 16, as shown, for example, by the reference numeral 30*c*, all in a curved configuration to form the inlet 42. At the top of the face 50, the tubes 24–34 are bent back into the plane of the wall 12, as shown, for example, by the reference numeral 30*d*, to rejoin the tubes 18 forming the wall 12.

A pair of tubes 20 and 22 extending to one side of the series of tubes 24–34 and a pair of tubes 36 and 38 extending to the other side of the series of tubes 24–34 are also bent out of the plane of the wall 12 to form upwardly, diagonally extending portions but at an angle from the vertical slightly greater than the initial 20° bends made in the series of tubes 24–34. The initial bends of the tubes 20, 22, 36 and 38 are also at a point in the wall 12 which is slightly higher from the base of the combustor 10 than the point at which the initial bends of the tubes 24–34 are made. The tubes 20, 22, 36 and 38 are then bent back approximately 90° towards the combustor 10 so that they extend "behind" the portions of the tubes 24–34 which comprise the face 50. The arrangement is such that the tube 20 extends immediately behind the tube 24, the tube 22 extends immediately behind the tubes 24 and 26, the tube 36 extends immediately behind the tubes 32 and 34, and the tube 38 extends immediately behind the tube 34. The tubes 20, 22, 36 and 38 are finally bent back into the plane of the wall 12 to rejoin the tubes 18 forming the wall 12.

The tubes 20–38 can be bent in any known manner with the fins 40, which normally extend between adjacent tubes, being omitted where necessary, such as between the portions of the tubes 34 and 36 as they define the face 50. The sizes of the fins 40 are increased in width where necessary to maintain the combustor 10 as an air-tight structure, such as a fin 40*a* which extends between the tube 38 and a tube 18*a* for the portion of the tube 38 bent out of the wall 12.

As a result of the foregoing, two generally circular inlets 42 and 44 are formed which receive the downspouts 46 and 48, respectively, it being understood that the downspouts are secured in their respective inlets in any known manner, such as by welding the downspouts to the innermost tubes defining the inlet which, in the case of the inlet 42, would be the tubes 28 and 30.

In operation, the bed of particulate material is fluidized and ignited to begin the combustion of the fuel. As fuel is consumed, additional fuel is delivered to the bed of the combustor 10 through the downspouts 46 and 48. Pivotally mounted distributor trays (not shown) can be used in connection with the downspouts 46 and 48 to insure a uniform distribution of the incoming fuel across the surface of the bed. Fluid from an external source is passed through the tubes 18–38 comprising the walls 12, 14 and 16 (and those not shown) to raise the temperature of the fluid so that it can be used to perform work.

Several advantages result from the foregoing. For example, almost any material, including those with high cohesive strengths, can be delivered into the combustor 10 through the downspouts 46 and 48 since the slopes of the downspouts are nearly vertical, i.e., the downspouts are disposed at relatively large angles to the horizontal. The orientation prevents plugging of the downspouts and provides a steady, even flow of fuel. Therefore, the technological limits on the types of materials which can be fed into fluidized bed combustors are eliminated allowing fluidized bed combustors to achieve their full potential in fuel flexibility. Additionally, the inlets 42 and 44 are formed from tubed walls which allow greater heat transfer from the combustor 10.

It is understood that several variations may be made in the foregoing without departing from the scope of the present invention. For example, the distance from the wall 12 to the centerline of the inlets 42 and 44 can be varied to accommodate a variety of downspout sizes and shapes by bending the tubes 20–38 at different locations and angles. Further, the tubes 20–38 can be bent at angles to provide feed passages of nearly any orientation to accommodate vertically mounted to horizontally mounted downspouts. Also, more or less of the tubes 18–38 can be bent to form the inlets 42 and 44, again depending upon the size and shape of the downspouts. In addition, the present invention is not limited to use with fluidized bed combustors but can be used as an inlet to introduce a variety of materials to any tubed-wall heat exchanger such as a coal-fired furnace, separator or the like.

Other modifications, changes and substitutions are also intended in the foregoing disclosure and although the invention has been described with reference to a specific embodiment, the foregoing description is not to be construed in a limiting sense. Various modifications to the disclosed embodiment as well as alternative applications of the invention will be suggested to persons skilled in the art by the foregoing specification and illustration. Accordingly, it is appropriate that the appended claims be construed broadly and in a manner consistent with the true scope of the invention therein.

What is claimed is:

1. A heat exchanger feed system for distributing fuel through a heat exchanger wall formed by a plurality of tubes having first and second ends with adjacent tubes connected together to render said wall gas-tight, wherein the improvement comprises:

a portion of each of a first series of said tubes being bent out of the plane of said wall, being bent again to form a passage extending through said wall and disposed at an angle to the plane of said wall, and being bent back into the plane of said wall.

2. The improvement of claim 1 wherein said passage is circular.

3. The improvement of claim 1 further comprising a downspout extending into said passage and registering with the interior of said heat exchanger.

4. The improvement of claim 1 wherein each of said tubes in said first series comprises:

a first portion extending upwardly from said first end;

a second portion extending upwardly from said first portion and outwardly from said wall at an angle from the vertical;

a third portion extending upwardly from said second portion and inwardly towards said wall at an angle from the horizontal; and a fourth portion extending upwardly from said third portion to said second end.

5. The improvement of claim 4 wherein said first and fourth portions are vertical and said second and third portions extend at angels to said first and third portions.

6. The improvement of claim 4 wherein said passage is formed by bending said third portion of each of said tubes in said first series outwardly from the centerline of said passage in a curved configuration.

7. The improvement of claim 4 wherein said angle from the horizontal is an acute angle.

8. The improvement of claim 4 or 6 further comprising a second series and a third series of said tubes, said second and third series extending adjacent to the outermost tubes in said first series, respectively, each of said tubes in both said second and third series comprising:

a first portion extending upwardly from said first end;

a second portion extending upwardly from said first portion and outwardly from said wall at an angle from the vertical;

a third portion extending upwardly from said second portion and inwardly towards said wall at an angle from the horizontal, said third portions of said tubes in said second and third series extending behind said third portions of said tubes in said first series; and a fourth portion extending upwardly from said third portion to said second end.

9. The improvement of claim 8 wherein said first and fourth portions of said tubes in said second and third series are vertical and said second and third portions of said tubes in said second and third series extend at angles to said first and third portions thereof.

10. A heat exchanger feed system comprising:

a plurality of tubes connected together and arranged to form at least a portion of the walls of a gas-tight enclosure;

at least one opening extending through at least one of said walls, said opening being contained in a plane extending at an angle to the plane of said wall; and a series of adjacent tubes extending around at least a portion of said opening with said tubes of said series first being bent out of the plane of said wall, then being bent around at least a portion of said opening, and then being bent back into the plane of said wall.

11. The heat exchanger feed system of claim 10 wherein said opening is circular and portions of each tube of said series of tubes extend for approximately one-half of the circumference of said opening.

12. The heat exchanger feed system of claim 10 further comprising a downspout extending into said opening and registering with the interior of said heat exchanger to form a cylindrical passage into said heat exchanger which passage extends at an angle to said wall.

13. A method for forming a feed inlet in a heat exchanger wall formed by a plurality of parallel tubes having first and second ends with adjacent tubes connected together to render said wall gas-tight comprising the steps of bending a portion of each of a first series of said tubes out of the plane of said wall, further bending said tubes to form a passage extending through said wall and disposed at an angle to the plane of said wall, and then bending said tubes back into the plane of said wall.

14. The method of claim 13 further comprising the step of extending a downspout into said passage to register with the interior of said heat exchanger.

15. The method of claim 13 wherein each of said tubes in said first series is bent to form:

a first portion extending upwardly from said first end;

a second portion extending upwardly from said first portion and outwardly from said wall at an angle from the vertical;

a third portion extending upwardly from said second portion and inwardly towards said wall at an angle from the horizontal; and a fourth portion extending upwardly from said third portion to said second end.

16. The method of claim 15 wherein said first and fourth portions are vertical and said second and third portions extend at angels to said first and third portions.

17. The method of claim 15 wherein said third portion of each of said tubes in said first series is bent outwardly from the centerline of said passage in a curved configuration to form said passage.

18. The method of claim 15 wherein said angle from the horizontal is an acute angle.

19. The method of claim 15 or 17 further comprising the steps of bending a second series and a third series of said tubes, said second and third series extending adjacent to the outermost tubes in said first series, respectively, wherein each of said tubes in both said second and third series is bent to form:

a first portion extending upwardly from said first end;

a second portion extending upwardly from said first portion and outwardly from said wall at an angle from the vertical;

a third portion extending upwardly from said second portion and inwardly towards said wall at an angle from the horizontal, said third portions of said tubes in said second and third series being bent to extend behind said third portions of said tubes in said first series; and a fourth portion extending upwardly from said third portion to said second end.

20. The method of claim 19 wherein said first and fourth portions of said tubes in said second and third series are bent to the vertical and said second and third portions of said tubes in said second and third series are bent to extend at angles to said first and third portions thereof.

* * * * *